US005081801A

United States Patent [19]

Fylak

[11] Patent Number: 5,081,801

[45] Date of Patent: Jan. 21, 1992

[54] BLASTING WHEEL APPARATUS AND BLADES THEREFOR

[76] Inventor: Stefan Fylak, 463 Fairall Street, Ajax, Ontario, Canada, L1S 1R8

[21] Appl. No.: 657,268

[22] Filed: Feb. 19, 1991

Related U.S. Application Data

[63] Continuation of Ser. No. 484,281, Feb. 26, 1990, abandoned.

[30] Foreign Application Priority Data

Mar. 2, 1989 [CA] Canada ..... 592915

[51] Int. Cl.[5] ..... B24C 5/06

[52] U.S. Cl. ..... 51/435; 51/428; 51/431; 51/432

[58] Field of Search ..... 51/428, 431, 432, 434, 51/435

[56] References Cited

U.S. PATENT DOCUMENTS 2,352,588 6/1944 Rosenberg et al. ..... 51/432

4,480,413 11/1984 Schulte et al. ..... 51/435

*Primary Examiner*—M. Rachuba

*Attorney, Agent, or Firm*—Arne I. Fors; Jeffrey T. Imai

[57] ABSTRACT

The invention provides a blasting wheel apparatus having a wheel with a plurality of like blade elements having generally an "I" shape in cross section including a base having a hooking member at one end and a lug at the opposite end thereof extending downwardly therefrom for anchoring with corresponding recesses of the wheel. The lug also extends outwardly from the end of the blade forming a bearing surface substantially co-planar with but opposed in direction to the bottom surface of the blade. A flange is presented to the bearing surface of each blade upon full registration of the hooking member and lug of each blade within corresponding recesses of the wheel. The blades are secured from separation from the wheel by a bolt presented to a tapered axial opening and upon full registration of the bolt thereby clamping the flange, blades and wheel together.

9 Claims, 2 Drawing Sheets

BLASTING WHEEL APPARATUS AND BLADES THEREFOR

This application is a continuation of application Ser. No. 484,281, filed Feb. 26, 1990 (now abandoned).

FIELD OF INVENTION

This invention relates to improvements in blasting wheel apparatus for accelerating and directing a finely divided or particulate material having a selected degree of hardness against the surfaces of metallic components particularly or other articles to be treated so as to clean, peen, roughen or polish same by abrasion and more particularly to improvements in the interlock between and the seducement of the "wheel" or disc-like element and associated blades or vanes thereof.

BACKGROUND TO THE INVENTION

A blasting wheel apparatus utilizes centrifugal forces imparted by a driven bladed or vaned "wheel" mounted for rotation within a housing closely enclosing same which housing has a configuration and is so apertured as to define therewith an inlet centrally thereof in the region of the axis of rotation communicating with the internal passageways or channels extending radially outwardly therefrom between the blades and leading to an outlet arranged in generally tangential relation to the bladed wheel periphery whereby the particulate material delivered centrally to the inlet thereof and accelerated under imparted centrifugal forces along the passageways or channels between the blades is discharged from the outlet in a continuous tangentially oriented stream which can be directed against the targeted surface of the component or other article to be treated.

Blasting wheel apparatus of the type under consideration is used in assembly line production where such apparatus may run continuously for several hundreds of hours with the bladed wheel driven between 1800 and 3600 r.p.m.

The particulate material used in those circumstances is highly abrasive and has the effect of wearing away the surfaces of the blades and wheel exposed thereto so that replacement becomes necessary.

The blade surfaces are subjected to greater wear as compared to the exposed surfaces of the wheel in such arrangement and accordingly the blades and supporting wheel are constructed so that they releasably interlock whereby the blades can be replaced when they have become too worn.

The blades for such blasting wheel apparatus are usually cast from abrasion resistant steel and then machined to the desired shape or configuration to achieve longer life. The wheel or disc-like element can either be likewise cast and machined or otherwise derived from suitable metal plate which can then be machined and surface hardened in accordance with known procedures.

It is important however that the upright disposition of blade or vane to the wheel surface be substantially maintained throughout the operational life of the interlocked components so as to promote maximum efficiency and therefore the interconnection between blade and plate should be capable of withstanding deformation or displacement over the aforementioned extended interval of time. Moreover not only should the interlock between blade and wheel be sufficiently strong and durable it also is desirable that engagement and disengagement be readily accomplished so as to minimize downtime.

Accordingly simplicity of form that utilizes a minimum number of components and manipulations yet achieves the requisite strong and durable interconnections and removal for replacement will not only ensure acceptance but contribute as well to efficiency and cost savings in the manufacture of the apparatus.

A number of arrangements for securing the blades or vanes to the wheel have been proposed which are exemplified by the following patents:

U.S. Pat. No. 4,649,673 shows the blades or vanes each attached to the wheel by threaded bolts the heads of which upstand in the respective passageway or channel directly in the path of the accelerating particulate material so that the bolt heads are each subjected to severe wear which may not only weaken the connections and render them unstable but makes each bolt removal and blade or vane replacement difficult as well as time consuming.

The abrasive effects of the bolts becomes the critical factor in scheduling replacement of the blades of the blasting wheel apparatus of U.S. Pat. No. 4,649,673. The bolts generally become abraded more rapidly than the blades themselves, thus requiring replacement before the blades. Accordingly, this blasting wheels apparatus is inefficient as the blades of the blasting wheel apparatus are replaced before such replacement is necessary.

U.S. Pat. No. 3,241,266 reveals blades or vanes each attached to the wheel by a dove-tailed inter-engagement with the wheel presenting machined grooves extending radially and opening to the periphery and the blades or vanes presenting the machined complementary projections which are to be inserted in the grooves or withdrawn therefrom radially from the wheel periphery.

The blades or vanes of U.S. Pat. No. 3,241,266 are adapted to be secured to the wheel by a centrally located removable ring-shaped locking ring and peripherally by inserting wedge type locking pins and incorporate other elements to ensure the requisite interlock to maintain upright disposition of blades or vanes to the wheel surface.

Such complexity of the interlock between blade or vane and wheel make it costly to produce and vulnerable to breakdown as well as difficult and time consuming either when installing or replacing the blades or vanes. Further, the particulate material may work its way in between the blade element and the groove increasing the pressure between the blade element and the groove making the removal of the blade elements from the wheel face difficult and time consuming.

Other U.S. patents of interest include the following:

U.S. Pat. No. 2,582,702
U.S. Pat. No. 3,162,983
U.S. Pat. No. 3,160,992
U.S. Pat. No. 3,197,920
U.S. Pat. No. 3,287,858
U.S. Pat. No. 4,333,278
U.S. Pat. No. 4,402,163
U.S. Pat. No. 4,473,972
U.S. Pat. No. 4,480,413

OBJECTS OF INVENTION

It is an object of this invention to provide a simplified structure of a blasting wheel apparatus for releasably securing blade elements of same against separation from the wheel or disc of a blasting wheel while providing the requisite degree of stability and strength of interlock between the wheel and the blade elements and the proper orientation thereof thereby reducing the time required in replacing the blades and reducing downtime of the blasting wheel apparatus.

FEATURES OF INVENTION

The disadvantages of the prior art may be overcome by simplifying the structure of the blade elements and wheel and the interlock therebetween to secure the blade elements from separation from the wheel or disc and by reducing the number of components subjected to the abrasive effects of the particulate material.

A blasting wheel apparatus is provided with a plurality of like blade elements having generally an "I" shape in cross section including a base having a hooking member at one end thereof and extending therefrom for anchoring with the wheel. The opposite end of the blade from the hooking member is provided a lug extending downwardly from the bottom surface for anchoring in the wheel after engagement of the hooking member with the wheel. The lug also extends outwardly from the end of the blade forming a bearing surface substantially co-planar with but opposed in direction to the bottom surface of the blade.

A wheel is provided having a wheel face including a plurality of surface recesses in equally circumferentially spaced apart relation to each other and a peripheral surface including a plurality of peripheral recesses in equally circumferentially spaced apart relation to each other and in radial alignment with the surface recesses of the wheel face.

The hooking member of the first blade to be installed is inserted into the peripheral recesses of the wheel for anchoring therewith, thereby restricting axial, circumferential and radially inward movement of the radially outward end of the blade.

The lug of the first blade is then presented to the corresponding surface recesses of the wheel or disc for anchoring therewith, thereby restricting radial and circumferential movement of the radially inward end of the blade.

The operation is repeated until all blades have been presented to and engaging with the wheel.

A flange having a central opening is presented to and engages all of the bearing surfaces of the blades.

The blades can be secured to the wheel by a locking means comprising a threaded bc inserted axially through the flange engaging the opposed bearing surfaces of the blades, through a central bore of the wheel and into the threaded bore in a spindle of the rotatable drive means. Upon full registration of the threaded bolt, the flange, blades and wheel are clamped between the head of the bolt and the spindle and together thereby securing the blades against separation from the wheel or disc while maintaining the requisite orientation of the blades substantially perpendicular to the wheel face and the degree of strength and durability of the interlock between blade and wheel.

For removal of the blades, the bolt is removed. The flange is then removed exposing the opposed bearing surfaces of the blades. The blades can then be removed and replaced.

DRAWINGS

These and other objectives and advantages of this invention will hereinafter appear and for purposes of illustration, but not of limitation, an embodiment of the invention is shown in the following drawings in which.

PREFERRED EMBODIMENT OF THE INVENTION

Figure 1:
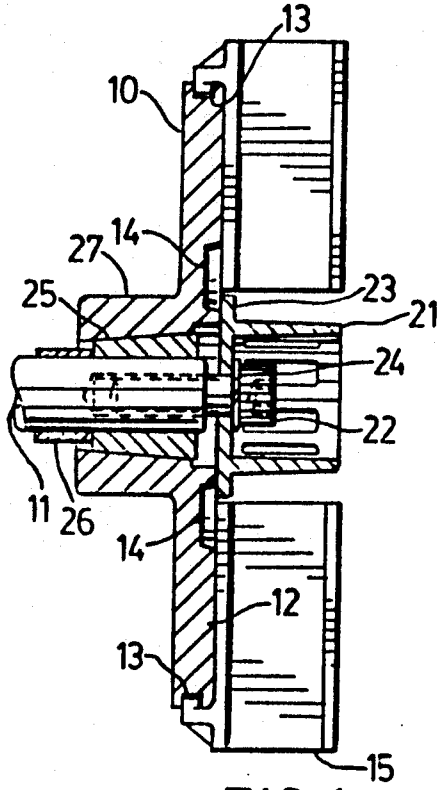
FIG. 1 is a sectional elevational view of the blasting wheel illustrating the preferred embodiment of the invention.
Figure 4:
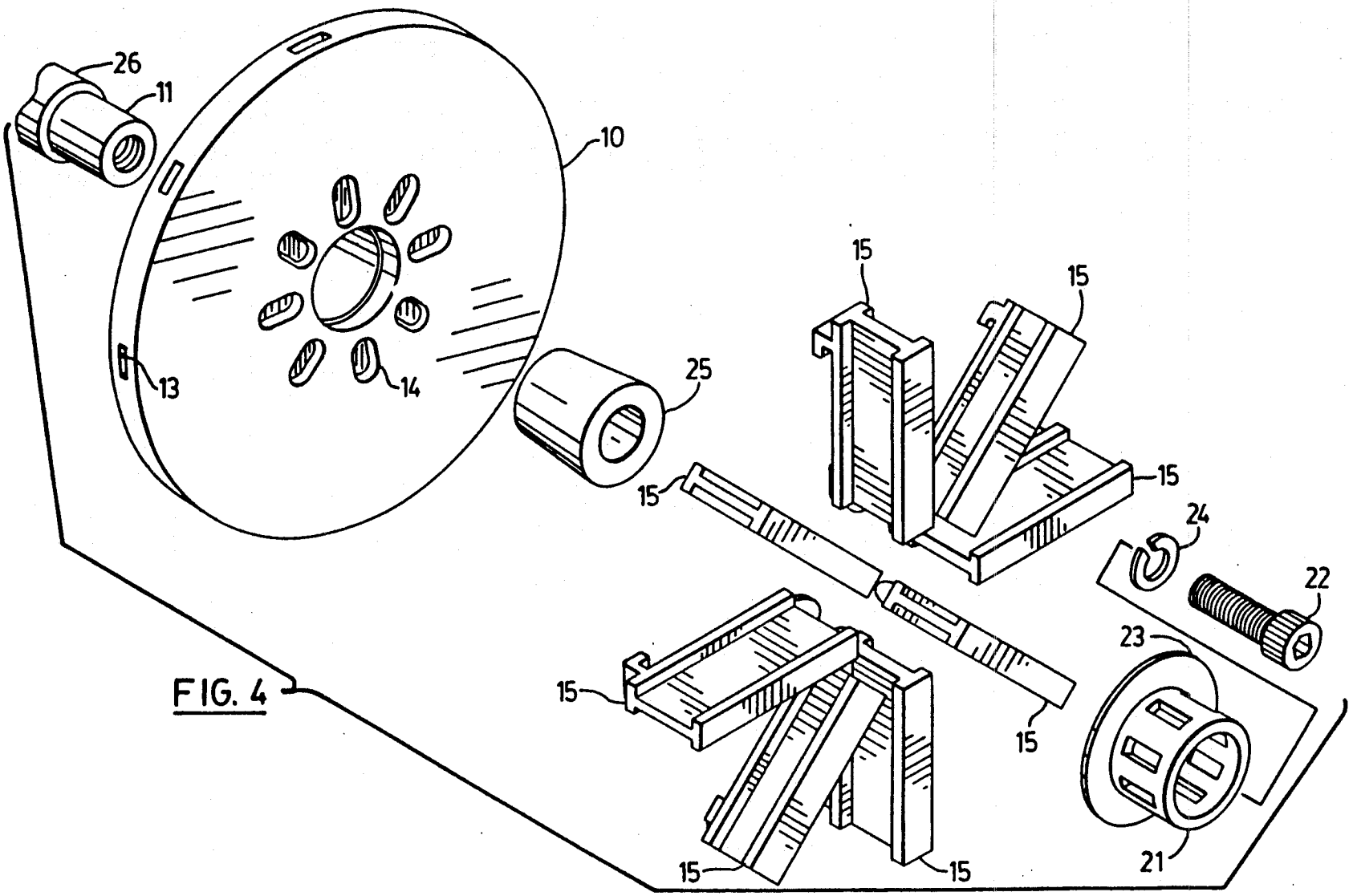
FIG. 4 is an exploded perspective view of the preferred embodiment illustrated in FIG. 1.

The blasting wheel apparatus illustrated in FIG. 1 comprises a wheel 10 mounted on a rotatable drive means (not illustrated) comprising a spindle 11 being rotatably driven by a motor (not illustrated). The rotatable drive means is mounted on a fixed base plate or foundation (not illustrated). Wheel 10 having a plurality of blades 15 attached thereto rotates about the same axis of rotation as the spindle.

A housing (not illustrated) having a width of the same order as the thickness of blades 15 and wheel 10 houses wheel 10 and is secured to the fixed base plate substantially sealing the housing to the base plate. An opening in one wall of the housing centrally thereof is provided to permit spindle 11 to extend therethrough. An opening in the opposite wall of the housing centrally thereof in the region of the axis of rotation is provided to present a funnel (not illustrated) for channeling particulate material into the centre of the wheel 10.

The fixed base plate and housing are provided with an opening directly below the wheel 10 to permit the particulate material accelerated to exit. An object to be abraded is passed by the opening in the base plate whereby the particulate material accelerated impinges upon the object thereby abrading or polishing the surface thereof.

In the embodiment as shown in FIG. 1, wheel 10 has a central bore having a diameter greater than the diameter of spindle 11. The central bore of wheel 10 has a taper decreasing in diameter as the bore extends away from wheel face 12. A tapered bushing 25 is provided having a central inner bore substantially equal in diameter to the diameter of spindle 11 and an outer taper complimentary to taper of the central bore of wheel 10. Spindle 11 is provided with an annular ring or shoulder 26 which is fixed to or integral with spindle 11 at a distance inwardly from the end of spindle 11.

Tapered bushing 25 is inserted in the central bore of wheel 10 from the same side as wheel face 12. Wheel 10 is installed onto the end of spindle 11 by presenting tapered bushing 25 to spindle 11 for abutment with annular ring 26. Wheel 10 is pushed further onto spindle 11 creating radial pressure between wheel 10 and tapered bushing 25 and spindle 11 thereby securing wheel 10 to spindle 11 for rotation.

It is readily apparent that wheel 10 may fit on various diameters of spindle 11 by replacing tapered bushing 25 with a similar tapered bushing 25 having the same outer configuration but having an inner diameter substantially equal to that of spindle 11.

Figure 2:
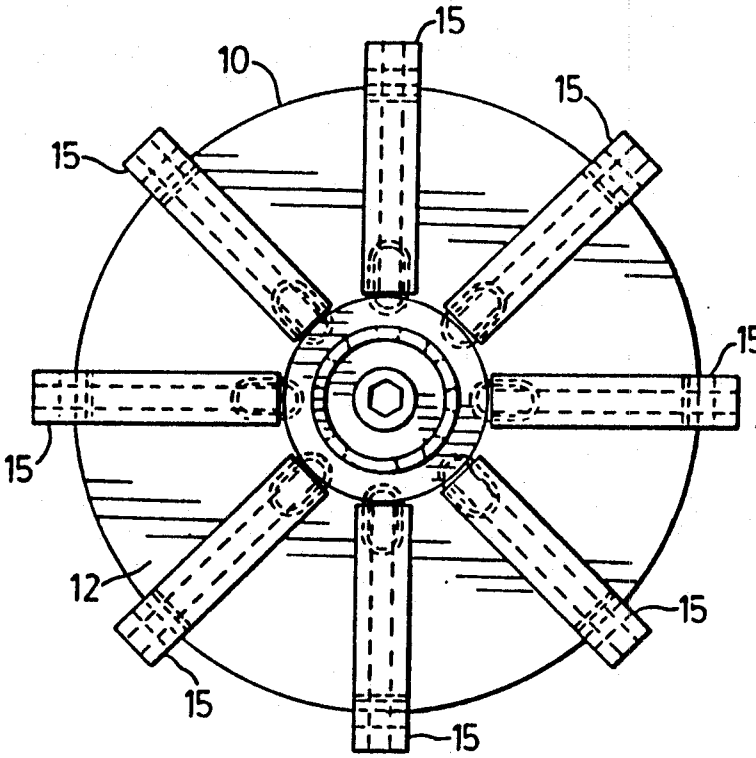
FIG. 2 is a front elevational view of the preferred embodiment illustrated in FIG. 1.

The blasting wheel illustrated in FIGS. 1 and 2 comprises wheel 10 having a central tapered bore with tapered bushing 25 inserted therein. Wheel 10 is mounted on spindle 11 within a housing which presents a planar wheel face 12 normal to the axis of rotation. Wheel 10 comprises a boss 27 extending from the face of wheel 10 opposite to wheel face 12. Wheel 10 comprises a plurality of peripheral recesses 13 opening to the perimeter thereof and aligned and corresponding with inwardly disposed inscribed surface recesses 14 in equally circumferentially spaced apart relation and radially spaced about the axis of rotation.

Figure 3:
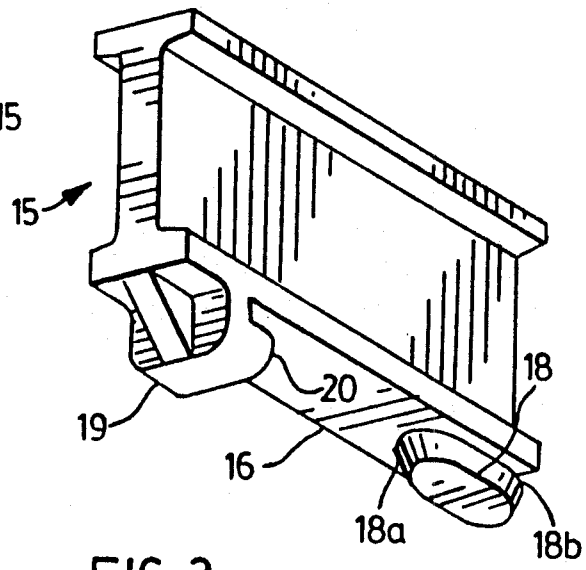
FIG. 3 is a perspective view of one of the blades of the preferred embodiment illustrated in FIG. 1.

Blades 15 of which there are eight in number in the embodiment illustrated are of uniform or like configuration in the preferred embodiment, and as best illustrated in the perspective view of FIG. 3, have an "I" shaped cross section presenting bottom surfaces 16 for contacting wheel face 12 of wheel 10.

The bottom surface 16 of each blade 15 at an end thereof presents a lug 18 which extends downwardly from bottom surface 16 and beyond the end to present both an inner bearing surface 18*a* corresponding to the contours of the surface recesses 14 and an opposed bearing surface 18*b*. Opposed bearing surface 18*b* lies substantially in the same plane as bottom surface 16 of blades 15, but facing opposite to bottom surface 16 of blades 15.

In the embodiment shown in FIGS. 3, lug 18 is shown as having an oval base and having the radii of the ends of the oval decrease as lugs 18 extends downwardly from bottom surface 16 forming inner bearing surface 18*a* at an angle to bottom surface 16.

The configuration of the bearing surfaces 18*a* of lugs 18 of blades 15 preferably match the contours of the surface recesses 14 inscribed in the surface 12 of wheel 10.

Blades 15 are also provided with a hooking member 19 extending downwardly from the bottom surface 16 at the end opposite of the lugs 18. Depending portion 20 of the hooking member 19 extends towards lugs 18. The distance between depending portion 20 and bottom surface 16 must be substantially equal to the distance between peripheral recess 13 and wheel face 12.

The configuration of the depending portions 20 of hooking member 19 matches the contours of the peripheral recesses 13 of wheel 10.

The apparatus in assembled form as illustrated in FIGS. 1 and 2 shows the depending portions 20 of hooking members 19 of the blades 15 fully registered within the peripheral recesses 13 and thus interlocking with wheel 10. Lugs 18 anchors within surface recesses 14 by having lugs 18 fully registered in surface recesses 14 with bearing surfaces 18*b* presented radially inwardly of the inner ends of blades 15 and in general co-planar relationship with wheel face 12 of wheel 10.

Flange 23 and impeller 21 are illustrated as being integral with each other. Impeller 21 is configured as a hollow cylinder having openings along the axial length of the wall of impeller 21. The openings facilitate the particulate material to enter the bladed portion of the wheel 10 in a uniform flow upon the particulate material being presented to the eye or centre of impeller 21 through a funnel connected to a hopper for retaining the particulate material (not illustrated).

Flange portion 23 presented by impeller 21 and centered on the axis of spindle 11 overlies the opposed bearing surfaces 18*b*. Spindle 11 is provided with a central bore having a tapped opening. The thread of the tapped opening and that of bolt 22 are complimentary.

Bolt 22 is presented to the tapped opening and is rotated bolt 22 in one sense for full registration of bolt 22 within the tapped opening in spindle 11 using an appropriate lock washer 24 (or other appropriate locking means), blades 15, wheel 10 and impeller 21 are clamped together and secured to spindle 11 for rotation.

Blades 15 may be removed from wheel 10 after rotating bolt 22 in an opposite sense. Once bolt 22 is removed from spindle 11, impeller 21 may be removed thereby exposing opposed bearing surfaces 18*a* of blades 15. Blades 15 may then be removed for replacement and re-installation.

OPERATION OF INVENTION

In operation, wheel 10 is provided with a tapered bushing 25 and together are placed inside of the housing (not illustrate) and then mounted onto spindle 11 until tapered bushing abuts annular ring or shoulder 26. Axial pressure is applied to wheel face 2 of wheel 10 forcing wheel 10 onto tapered bushing 25 securing wheel 10 on spindle 11.

The housing covers the blasting apparatus and is secured by conventional means to the base plate (not illustrated) for operation thereof.

A housing is provided with a releasable lid which is removed for installation of the blades. A funnel (not illustrated) for channeling the particulate material to the centre of wheel 10 is removed thereby exposing an opening in the side of the housing at the centre of rotation of wheel 10 for accessing wheel face 12 of wheel 10.

Blades 15 are installed one at a time onto the wheel face 12 of wheel 10 by first inserting hooking member 19 of blades 15 and in particular depending portion 20 is inserted into peripheral recess 13 of wheel 10 and interlocking with wheel 10. Lug 18 of blades 15 is inserted into and anchored within corresponding surface recess 14 on wheel face 12 of wheel 10 until bottom surface 16 of blades 15 abuts wheel face 12 and opposed bearing surface 18*b* is substantially co-planar with but not below the surface of wheel face 12.

All blades are mounted on wheel 10 in a similar fashion. Impeller 21, having flange portion 23, is then inserted through the opening in the side of the housing and presented to wheel face 12 for overlaying the opposed bearing surfaces 18*b* and centered with wheel face 12.

Bolt 22 is then inserted through locking washer 24 and through the centre of impeller 21 and through the centre of wheel 10.

So arranged, bolt 22 is presented to a tapped axial opening of spindle 11. Bolt 22 is rotated in one sense until full registration of the threaded bolt 22 within the tapped axial opening in spindle 11 thereby clamping blades 15, wheel 10 and impeller 21 together and to the spindle 11 for rotation.

Blades 15 are securely clamped to wheel 10.

Full registration of hooking member 19 into peripheral recesses 13 restricts circumferential, axial and radially inward movement of blades 15. Full registration of lugs 18 in surface recesses 14, inner bearing surface 18*a* engages the wall of surface recesses 14 thereby restricting circumferential and radial movement of blades 15. Flange 21 engages bearing surfaces 18*b* and is securely clamped through wheel 10 and into spindle 11 thereby restricting axial movement of blades 15. Blades 15 are securely clamped to wheel 10 in the preferred orientation and with the requisite degree of stability.

The funnel for channeling the particulate material is replaced covering the opening in the side of the housing. The lid is placed over the top of the housing and secured for operation of the blasting wheel apparatus.

For removal of the blades, the housing lid is opened or removed exposing the top of wheel 10. The funnel for channeling particulate material is removed thereby exposing the opening in the side of the housing, making bolt 22 accessible. Bolt 22 is rotated in a sense opposite to the sense used to install the blades. Impeller 21 and flange 23 is then removed exposing opposed bearing surfaces 18*b*. Blades 15 may then be removed for installation of replacement blades 15.

For installation of replacement blades 15, the steps outlined above are repeated.

It will be understood that modifications to the details of construction, arrangement and operation of the invention described can be made, without departing from the spirit of the invention.

I claim:

1. A blade for use in a blasting wheel apparatus for accelerating particulate materials comprising a single disc presenting a substantially planar disc face and a circumferential surface, having complimentary recess means comprising a plurality of like radially extending first recesses in said circumferential surface, spaced axially from said disc face and a plurality of like second recesses in said disc face in radial alignment with said first recesses and said disc mounted on a rotatable drive means, a plurality of like blades extending radially relative to said disc face and circumferentially spaced about said disc face, having anchoring means for engaging with said complimentary recess means of said disc whereby said anchoring means is remote from the path of the accelerating particulate materials, a flange for presenting to said plurality of blades upon being mounted onto said disc and a locking means for urging said flange, said plurality of blades and said disc together thereby securing said plurality of like blades from separation from said disc, wherein said blade comprising a base having a substantially planar base surface for presenting to said disc face, said anchoring means extending from said base and comprising a hooking member and a lug at opposite end regions of said blade, said hooking member having a depending portion extending substantially parallel with said base surface in a direction towards said lug, said depending portion adapted for matingly engaging said first recess, and a bearing means facing opposite said base surface and extending radially inward from said blade for engagement between said flange and said disc, whereby said blades are mounted onto said disc by first registering said hooking member within one of said first recesses and secondly registering said lug within a radially aligned second recess, applying said flange to said bearing means and locking said blades to the disc.

2. A blade as claimed in claim 1 wherein said lug and said bearing means are integral with each other.

3. In a blasting wheel apparatus for accelerating particulate material comprising a single disc presenting a substantially planar disc face and a circumferential surface and mounted on a rotatable drive means, said disc having complimentary recess means comprising a plurality of radially extending first recesses in the circumferential surface, spaced axially from said disc face and a plurality of second recesses in said disc face in radial alignment with said first recesses, a plurality of like blades each having a substantially planar base surface for presenting to said disc face, and having anchoring means remote from the path of the accelerating particulate material for engaging with said complimentary recess means of said disc and having bearing means for receiving a flange, said bearing means facing opposite said base surface and extending radially for engagement between said flange and said disc, said flange engaging a plurality of said bearing means and a locking means urging said flange, said bearing means and said disc together thereby securing said plurality of like blades from separation from said disc, said anchoring means comprising a hooking member and lug at opposite end regions of said blades, said hooking member having a depending portion extending substantially parallel to said base surface in a direction towards said lug, said depending portion adapted for matingly engaging one of said first recesses and said lug for presenting to said second recesses corresponding in radial alignment, whereby said blades are mounted onto said disc by first registering said hooking member within said first recess and secondly registering said lug within said second recess, applying said flange to said bearing means and locking said blades to the disc.

4. A blade as claimed in claim 3 wherein said flange is integral with an impeller for directing the flow of the particulate materials.

5. A blade as claimed in claim 2 wherein said lug has an elongated frusto-conical configuration whereby said lug is fully registered within said second recess upon said locking means securing said blades.

6. A blade as claimed in claim 5 wherein said locking means comprises a bolt for presenting to a tapped axial bore of said disc.

7. A blade as claimed in claim 5 wherein said rotatable drive means comprises a spindle for mounting said disc thereon having a tapped axial bore and said locking means comprises a single bolt for presenting to said tapped axial bore of said spindle.

8. In a blasting wheel as claimed in claim 3 wherein said locking means comprises a bolt for presenting to a tapped bore of said disc.

9. In a blasting wheel as claimed in claim 3 wherein said rotatable drive means comprises a spindle for mounting said disc thereon having a tapped axial bore and said locking means comprises a bolt for presenting to said tapped axial bore of said spindle.

* * * * *